United States Patent [19]

Howa, deceased et al.

[11] Patent Number: 4,779,632

[45] Date of Patent: Oct. 25, 1988

[54] METHOD FOR CONSTRUCTING ARTIFICIAL FINGERNAILS

[75] Inventors: Scott P. Howa, deceased, late of Salt Lake City, by Sharon C. Howa, personal representative; Bruce B. Bowns, Bountiful, both of Utah

[73] Assignee: West Tec Industries, Inc., Salt Lake City, Utah

[21] Appl. No.: 429,312

[22] Filed: Sep. 30, 1982

[51] Int. Cl.[4] ..... A45D 40/30

[52] U.S. Cl. ..... 132/200; 132/285; 132/73

[58] Field of Search ..... 132/88.5, 88.7, 73, 132/53.6, 11 A; 427/2

[56] References Cited

U.S. PATENT DOCUMENTS

| | | | |
|---|---|---|---|
| 2,031,225 | 2/1936 | O'Donnell | 132/88.5 |
| 3,169,536 | 2/1965 | Caracciolo, Sr. | 132/736 |
| 3,478,756 | 11/1969 | Sautter et al. | 132/73 |
| 4,114,271 | 9/1978 | Howa | 427/2 |
| 4,257,433 | 3/1981 | Kwan | 132/11 A |
| 4,299,243 | 11/1981 | Umstattd | 132/73 |

*Primary Examiner*—Richard J. Apley
*Assistant Examiner*—Robert Bahr
*Attorney, Agent, or Firm*—K. S. Cornaby

[57] ABSTRACT

An improved method is provided for constructing artificial fingernails. A fingernail form is inserted underneath the fingernail against the fingertip. A preferably acrylic-based compound is spread over the fingernail form and natural fingernail with a vibratory brush to create a lengthened fingernail having a natural appearance and great durability.

5 Claims, 1 Drawing Sheet

METHOD FOR CONSTRUCTING ARTIFICIAL FINGERNAILS

BACKGROUND OF THE INVENTION

This invention relates to a method for constructing artificial fingernails which adhere to the natural fingernails to give the appearance of naturally long fingernails. The art of sculpting artificial fingernails has not been widely accepted by the public due to the length of time necessary to construct such fingernails, the relatively short time before they become loose or chipped, and the poor quality and appearance of the final product.

Heretofore, the art of sculpting fingernails has been done by manually spreading an acrylic-based compound over, and outwardly from, the natural nail by means of a nail brush. This method of application does not allow the compound to be spread evenly, enables air bubbles to become trapped between the natural and artificial fingernails, and requires considerable time using special instruments to shape the nail. As a result, the artificial fingernail lacks the strength necessary to make it durable and does not properly adhere to the natural nail. Air pockets in the artificial nail are also known to be the cause of various infections.

The present invention overcomes the problems and inefficiencies characteristic of the method now in use. It is therefore an object of the present invention to provide a method for constructing artificial fingernails which are more durable, adhere more efficiently to the natural fingernail, and can be sculpted in a shorter time.

SUMMARY OF THE INVENTION

In accordance with the present invention, an improved method is provided for constructing artificial fingernails. A fingernail form is inserted beneath the extension of the natural fingernail against the fingertip. A compound for forming artificial fingernails is dispersed over the fingernail form and natural fingernail using a vibratory brush, such as that shown in U.S. Pat. No. 4,114,271. Use of the vibratory brush causes the compound to be distributed more compactly, thereby eliminating air bubbles and providing greater contact with the surface of the fingernail. The vibratory brush also facilitates application of the material more evenly and more rapidly than can be done by manually applying the compound without the vibratory brush. By holding the brush in a vertical position excess material which has accumulated at the cuticle can easily be removed.

After the desired shape of the artificial fingernail has been obtained, and the compound has dried, the fingernail is removed and the artificial fingernail is filed to remove any rough edges.

THE DRAWINGS

The preferred mode for carrying out the invention is illustrated in the accompanying drawings, in which:

FIG. 1 is a perspective view showing the manner in which the vibratory brush is used to accomplish the present invention;

FIG. 2 a top plan view, showing in greater detail the vibratory brush being used to spread the artificial fingernail compound over the natural fingernail and fingernail form;

FIG. 3 a side elevational view showing the artificial fingernail applied over the natural fingernail and fingernail form; and FIG. 4 a perspective view showing an artificial fingernail constructed in accordance with the present invention.

DETAILED DESCRIPTION OF THE DRAWINGS

The method for constructing artificial fingernails as illustrated in FIGS. 1–4 of the drawings is accomplished by following the following steps. It is desirable that the natural fingernail 11 be roughened with an emery board or the like to provide a suitable surface for adhesion of the artificial fingernail. Fingernail form 12, made of a flexible material, such as laminated cardboard or plastic, is constructed to conform to the contour of natural fingernail 11. Fingernail form 12 is inserted beneath natural fingernail 11 and against the fingertip, such that the top surface of form 12 appears to be a continuation of natural fingernail 11. The laterally extending portion of wing 13 of fingernail form 12 is pinched against the side of finger 14 to prevent form 12 from slipping or losing the proper arch.

Figure 1:
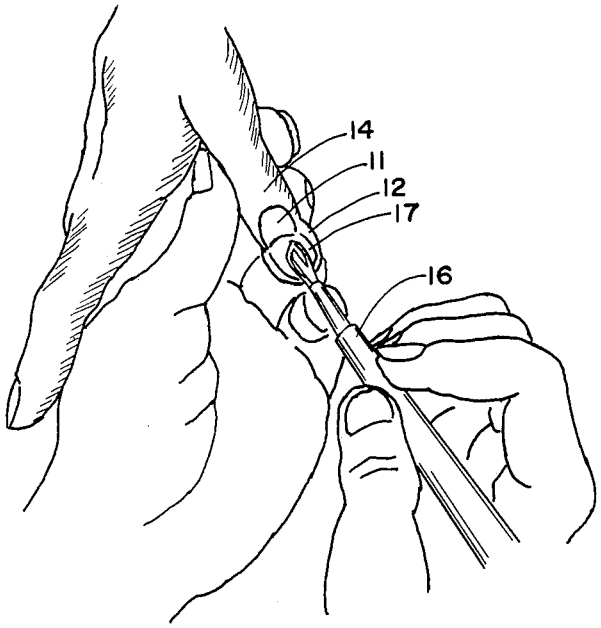
Figure 2:
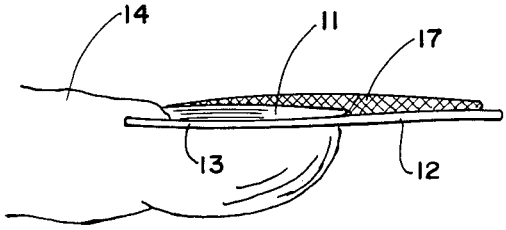
Figure 3:
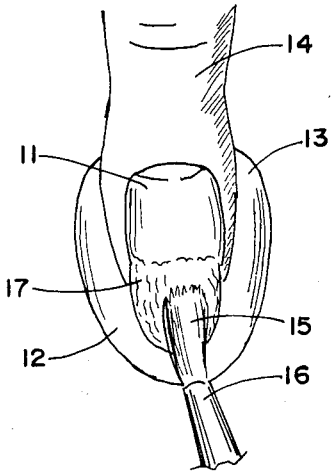
Figure 4:
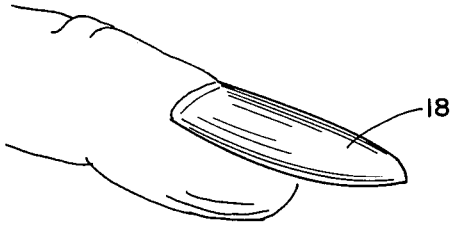

A brush tip 15 of a vibrator brush 16, which is preferably the vibrator brush disclosed in U.S. Pat. No. 4,114,271, is dipped consecutively into a preferably acrylic liquid and a white powder to form a paste 17 having the color of natural fingernail 11. Paste 17 is placed on fingernail form 12 near the natural fingernail tip. The vibration of brush 16 spreads paste 17 over natural fingernail 11 and fingernail form 12. The vibratory action of brush 16 mixes and compacts paste 17 as it is spread, thereby eliminating air bubbles and allowing paste 17 to be spread more evenly. Brush tip 15 is used to sculpt paste 17 into the desired shape. Fingernail form 12 is removed when paste 17 begins to harden but before it is fully set. The rough edges are filed with an emery board to provide an artificial fingernail 18 as shown in FIG. 4.

The method described herein provides natural appearing artificial fingernails which are more durable, more adhesive, and which can be constructed in a shorter time than provided by existing methods.

We claim:

1. In a method for constructing artificial fingernails, the steps of:

inserting a fingernail form conforming to the shape of a natural fingernail beneath the tip of the natural fingernail;

applying an artificial fingernail paste to the top surface of the natural fingernail and fingernail form with a vibrating brush tip having a source of vibration independent of the user; and spreading said fingernail paste to cover the natural fingernail and fingernail form in the shape of a fingernail with the vibratory motion of the vibrating brush tip to remove entrained air bubbles and adhere the paste firmly to the natural fingernail.

2. A method as set forth in claim 1, wherein said paste is an acrylic-based compound.

3. A method as set forth in claim 1, wherein the fingernail form is removed before the artificial fingernail paste is completely dry.

4. A method as set forth in claim 1, wherein the vibrating brush tip is used to apply the artificial fingernail paste.

5. A method as set forth in claim 1, wherein the fingernail form is constructed of a plastic material.

* * * * *